United States Patent [19]

Kirilloff et al.

[11] 4,100,526

[45] Jul. 11, 1978

[54] GRID RESISTOR

[75] Inventors: Victor V. Kirilloff, Murrysville; William A. Benson, Pittsburgh, both of Pa.

[73] Assignee: Mosebach Manufacturing Company, Pittsburgh, Pa.

[21] Appl. No.: 771,685

[22] Filed: Feb. 24, 1977

[51] Int. Cl.[2] ..... H01C 3/00

[52] U.S. Cl. ..... 338/279; 338/290; 338/295

[58] Field of Search ..... 338/277–280, 338/283, 284, 287, 288, 290, 291, 293, 295, 315–321, 51; 219/532, 536, 537, 539, 542, 552, 375, 382; 105/49, 61; 303/3, 7, 9, 15, 20

[56] References Cited

U.S. PATENT DOCUMENTS

| | | | |
|---|---|---|---|
| 2,875,310 | 2/1959 | Schoch | 338/284 |
| 3,858,149 | 12/1974 | Kirilloff | 338/315 X |
| 4,051,452 | 9/1977 | Luy | 338/280 X |

OTHER PUBLICATIONS

German Printed Application, Tungs, 1465881, Jan. 10, 1964.

*Primary Examiner*—C. L. Albritton

*Attorney, Agent, or Firm*—Buell, Blenko & Ziesenheim

[57] ABSTRACT

A frame supported grid resistor having a plurality of resistors of the ribbon type has located between adjacent ribbon resistors, strips of conductive material containing nonconductive bushings which engage and separate the adjacent ribbon resistors.

1 Claim, 3 Drawing Figures

GRID RESISTOR

This invention relates to an improved frame supported grid resistor such as is used in locomotive cars as a dynamic brake resistor.

Resistors used for dynamic braking of a locomotive car or other similar uses are subjected to excessive vibrations, have a confined space and are generally cooled by forced air from fans. Kirilloff in U.S. Pat. No. 3,858,149 discloses a frame supported grid resistor which provides for the use of thin ribbon-type resistors spaced and supported in a frame to enable air to freely pass through the resistors to cool them. A series of such frames containing a pair of ribbon-type resistors separated and supported by a center strip of electrical insulating material are then stacked in alignment to form a hexahedron structure. Without the support of this center strip the resistors, which become very hot during use, would sag and create a short circuit when they touched resistors in the frame below them. The center strip of electrical insulating material used in the frames disclosed in U.S. Pat. No. 3,858,149 significantly increases the weight of each frame. If several ribbons are used in each frame it becomes very difficult to handle and to stack them.

This invention provides for the use of bushings of electric insulating material inserted into a plate of noninsulating material rather than use of a strip composed of only insulating material. These plates are placed in the frame between adjacent ribbon type resistors to support and separate them. The result is to reduce the amount of electrical insulating material in the separating and support means. Because relatively lighter noninsulating material can be chosen for the plate, the separating means and, thus, the frame weigh much less than they would weigh if the separator had been made completely of electrical insulating material.

Other details, objects and advantages of this invention will become apparent as the following description of the present preferred embodiment proceeds in which.

Figure 1:
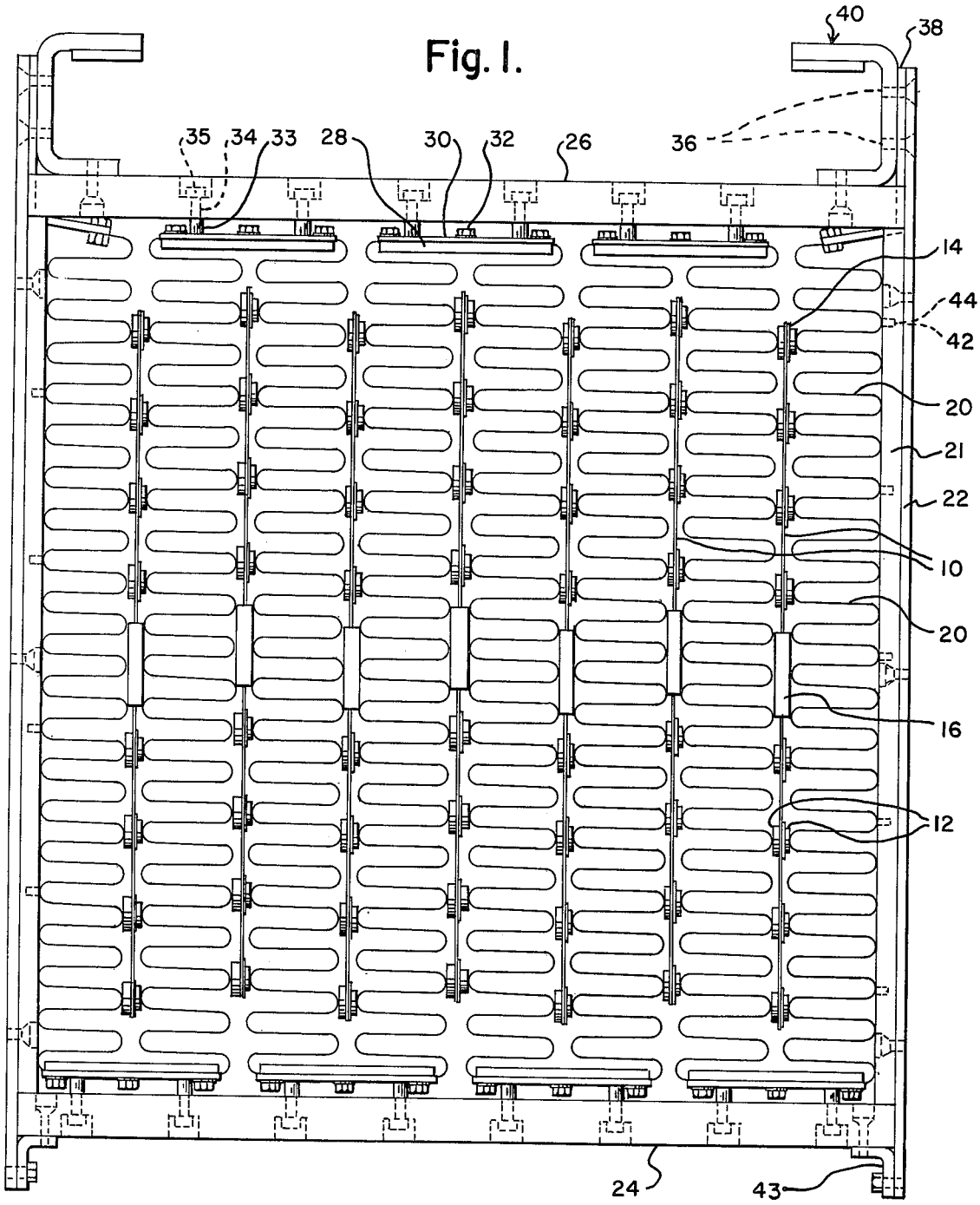
FIG. 1 is a plan view of the grid resistor frame.

FIG. 1 shows eight ribbon type resistors 20 separated by nonconductive bushings 12 that have been inserted into support plates 10 of noninsulating material. Nonconductive bumpers 16 are attached to the top and bottom edges of the support plate midway between the ends of said plate. When series of frames are stacked in alignment the lower bumpers in the bottom frame will rest on the floor while other bumpers will abut bumpers in adjacent frames thereby providing support for the center of the frame. The ends of each resistor 20 are connected in series by resistor connectors 30 each of which has been attached by a bolt 32 to a back plate 28. Each combination of resistor, connector and back plate is, in turn, attached to the nonconductive panels 24 and 26 by a threaded stud 34 passing through a bushing 33 and secured by a nut 35. Terminals 38 are attached to each end of the series of resistors 20. A conductive side panel 22, is attached to each terminal 38 and to a separator plate 21 made of nonconductive material. The separator plates 21 insulate the side panels 22 from the resistors nearest the side of the frame. Each plate 21 has holes 44 to receive studs 42 that have been attached to the ribbon resistor 20. (See FIG. 3) Brackets 40 are attached by screws 36 to the outside top corners of the frame to permit the frames to be mounted within the locomotive car. Braces 43 are attached to the outside bottom corners to provide support for the frame.

Figure 2:
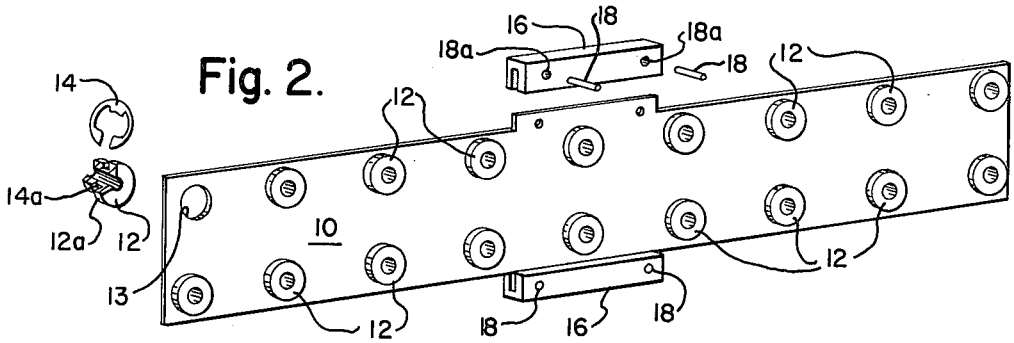
FIG. 2 is a perspective elevational view of the improved separation and support unit which is placed between the two ribbon resistors in the frame.

Referring to FIG. 2 the support plate 10 of noninsulating material is shown having a plurality of nonconductive bushings 12 inserted through holes 13 in the support plate 10. The bushings 12 are flanged at one edge **12*a* and held into place by an E-ring 14 engaging an annular groove 14*a*. Nevertheless, the bushings may be held in place by other suitable fastening means. Bumpers 16 made of nonconductive material are attached to the edges of the support plate 10 by pins 18*a* inserted into holes 18 in the bumper 16 or other fastening means. The bumpers 16** are positioned on the plate in a manner which will permit them to abut similar bumpers on adjacent support plates in frames which are located directly above or below them.

Figure 3:
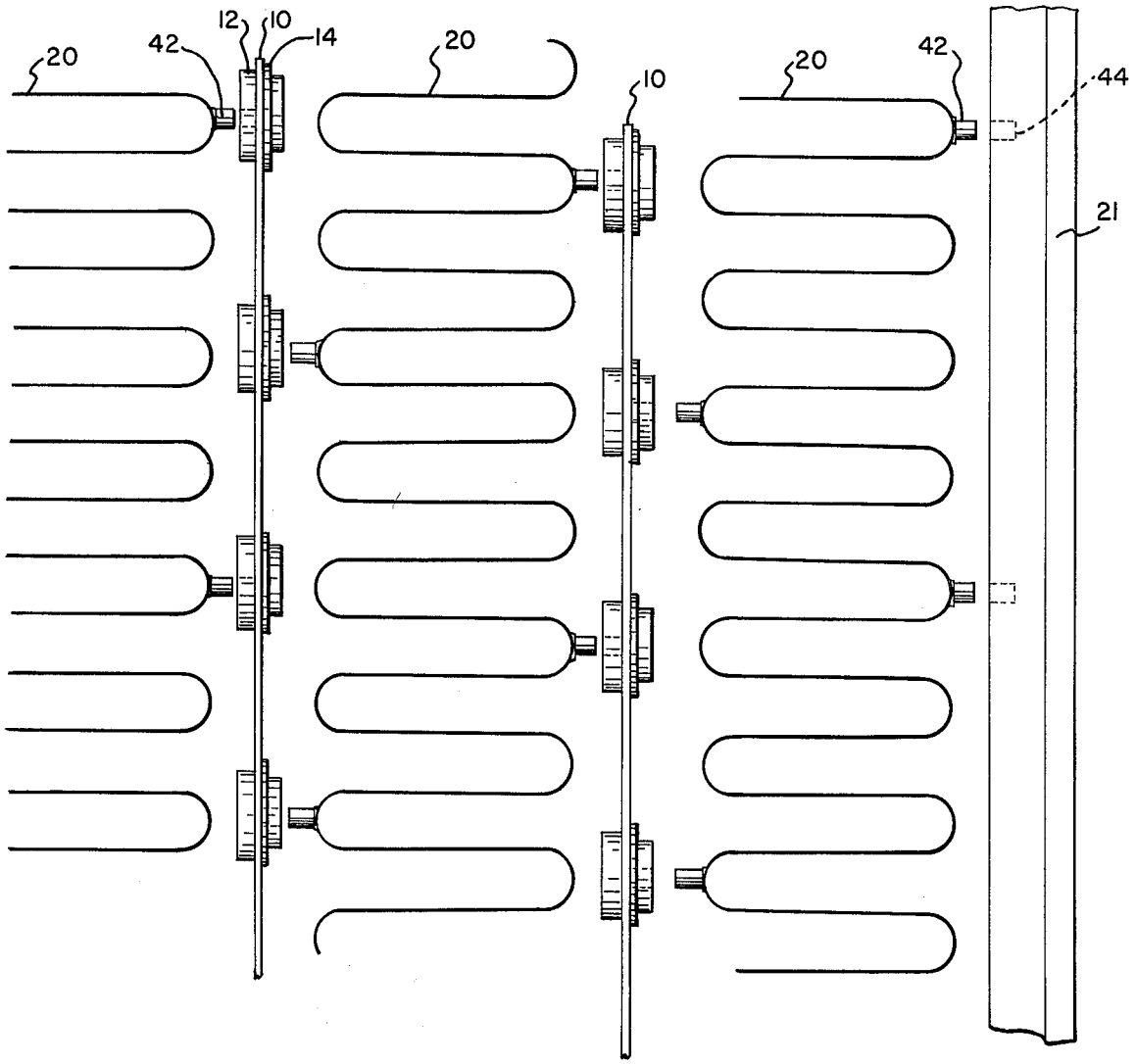
FIG. 3 is an enlarged fragmentary exploded view of a portion of the support frame showing how the resistors are attached to the separation and support unit.

FIG. 3 illustrates how the ribbon resistors are inserted into the bushings in the support plates. A stud 42 is either welded or riveted to the apex of selected U-portions of the ribbon resistor 20. The studs are then inserted into the nonconductive bushings 12 or the holes 44 in the separator plate 21. The studs are placed on the ribbon in such a way to allow only one stud to occupy a bushing. This arrangement provides support and insulation for the ribbon resistors within the frame.

While I have shown and described an embodiment of my invention it will be understood that this invention may be otherwise embodied within the scope of the following claims.

I claim:

1. A resistor structure forming a grid in a frame having a plurality of longitudinal fan folded electrically conductive resistive ribbons forming tips and supported within the frame wherein the improvement comprises:

(a) a support strip member of electrically conductive material and positioned longitudinally between two adjacent resistive ribbons, the strip member having a plurality of holes with bushings of electrical insulation material inserted in the holes, the ends of the strip member are free and are spaced from the frame;

(b) studs selectively joined to the tips of the resistive ribbons and alternating between tips of the resistive ribbon on one side of the support strip member and tips of the resistive ribbon on the other side of the support strip member, the studs each engage one of the bushings and only one tip with a stud engages each bushing and the tips with the studs abut the bushings engaged, tips without studs are spaced from the support strip member and the tips without studs which are transversely aligned with a bushing abut that bushing; and (c) a bumper member of electrical insulation material joined on a top edge of the support.

* * * * *